US005253454A

United States Patent [19]

Carlson et al.

[11] Patent Number: 5,253,454

[45] Date of Patent: Oct. 19, 1993

[54] METAL SKIN BUFFING FIXTURE AND STRUCTURE

[75] Inventors: Don F. Carlson, Bloomfield Hills; Richard Koch, Mt. Clemens, both of Mich.

[73] Assignee: Acme Manufacturing Company, Madison Heights, Mich.

[21] Appl. No.: 996,040

[22] Filed: Dec. 23, 1992

Related U.S. Application Data

[62] Division of Ser. No. 677,457, Mar. 29, 1991, Pat. No. 5,203,120.

[51] Int. Cl.[5] ..... B24B 41/06

[52] U.S. Cl. ..... 51/240 R; 51/237 T; 269/61; 269/289 R

[58] Field of Search ..... 51/240 R, 240 T, 216 ND, 51/216 T, 217 R, 237 R; 269/34, 43, 60, 61, 94, 130, 131, 218, 289 R, 303, 310, 315, 910, 909; 83/409, 409.1, 410, 410.7; 408/91; 409/344, 278, 219

[56] References Cited

U.S. PATENT DOCUMENTS

| | | | |
|---|---|---|---|
| 1,527,820 | 2/1926 | Sporer | 269/289 R |
| 2,320,079 | 5/1943 | Hartwig | 269/289 R |
| 2,324,919 | 7/1943 | Fine et al. | 269/61 |
| 2,469,815 | 5/1949 | Cutright | 269/61 |
| 2,545,953 | 3/1951 | Hall | 269/61 |
| 3,106,015 | 10/1963 | Herbert, Jr. . | |
| 3,935,987 | 2/1976 | Foster, Sr. et al. | 269/61 |
| 3,963,233 | 6/1976 | Worden | 269/289 R |
| 4,235,050 | 11/1980 | Hannaford et al. . | |
| 4,523,409 | 6/1985 | De Fazio . | |
| 4,550,532 | 11/1985 | Fletcher, Jr. et al. . | |
| 4,682,764 | 7/1987 | Renaud . | |
| 4,886,529 | 12/1989 | Hashimoto et al. . | |
| 4,907,371 | 3/1990 | Shoda et al. . | |

FOREIGN PATENT DOCUMENTS

| | | |
|---|---|---|
| 59-76761 | 5/1984 | Japan . |
| 61-188069 | 8/1986 | Japan . |
| 2-116466 | 5/1990 | Japan . |

OTHER PUBLICATIONS

Photographs—AMCE Mfg. Co. Robotic Deburring System shipped Sep. 23, 1987.

*Primary Examiner*—M. Rachuba

*Attorney, Agent, or Firm*—Harness, Dickey & Pierce

[57] ABSTRACT

A buffing fixture and structure for supporting large and thin metal skins during a finishing operation. The structure includes a plurality of individual form fixtures, at least one trunnion table mounted for rotation along a horizontally disposed axis, and a motor for causing the rotation of the trunnion table. Each of the form fixtures is comprised of a frame having at least one brace which extends outwardly from the frame, a form shell mounted to the frame such that the interior surface is in contact with a longitudinal edge of the brace, and a layer of foam disposed substantially along the entire interior surface of the form shell in order to support the surface area of the form shell. The form shell has a three dimensional shape which follows the three dimensional shape of the metal skin to be finished. A set of straps are also provided in order to removably secure and register the position of the metal skin to the form shell, such that the metal skin lies flush against the exterior surface of the form shell.

13 Claims, 17 Drawing Sheets

METAL SKIN BUFFING FIXTURE AND STRUCTURE

This is a division of U.S. patent application Ser. No. 07/677,457, filed Mar. 29, 1991, now U.S. Pat. No. 5,203,120, issued Apr. 20, 1993.

BACKGROUND AND SUMMARY OF THE INVENTION

The present invention relates generally to buffing large metal skins having different three-dimensional shapes, and more particularly to a buffing fixture and structure for supporting the exterior metal skins of airplanes during a buffing operation.

The exterior surface of an airplane is generally comprised of a plurality of large metal sheets, which are referred to as "skins". Previously, it has been a common practice to paint most or all of the exterior surface of the airplane to protect the surface of the skins. Recently, there has been a move to substitute for the use of paint on the skins highly polished metallic or "bright" surfaces. By providing bright surfaces, the airplane eliminates the weight of the paint and any drag caused by the paint. Additionally, the bright surfaces or highly polished exterior skins also provide a desirable cosmetic appearance for the airplane.

Each of the airplane skins are generally comprised of a very large and thin sheet of metal, such as steel or aluminum. Additionally, these skins will be fabricated in various sizes, shapes and contours. For example, the three-dimensional characteristics of a skin near the nose of the airplane will be considerably different than the three-dimensional characteristics of a skin used for the mid-section of the airplane. Accordingly, it should be appreciated that the large size, thinness and varying shapes of the airplane skins combine to make the task of buffing a set of airplane skins a formidable problem. For example, substantial pressure must be applied to the skins by a rotating buffing head in order to adequately polish the surface of the skins. However, due the fact that airplane skins are relatively thin, extreme care must be exercised to avoid damaging thereto. The problem may be analogized to buffing a sheet of foil. In other words, the buffing process could cause undesirable deformities or distortions in the shape of the skins.

Additionally, it would be desirable if the process of buffing a set of airplane skins could be automated in order to permit the airplane to be built as quickly and as cost efficiently as possible. However, the process would have to be capable of being adapted to the varying shapes of the skins, and a way of preventing the deformation of the skins would have to be developed.

Accordingly, it is a principal objective of the present invention to provide a buffing fixture and structure for supporting relatively large and thin metal sheets having various shapes, such as a set of skins for an airplane.

It is another objective of the present invention to provide a buffing fixture which will prevent any significant distortion or deformation of the skins as a result of an automated buffing process.

It is an additional objective of the present invention to provide a support structure which will permit a plurality of skins to be finished simultaneously.

It is yet another objective of the present invention to provide a support structure and method which will permit the use of one or more robots to buff the one or more skins while additional skins are being mounted to the same apparatus.

It is a further objective of the present invention to provide a support structure which will permit an exceptionally large skin to be buffed or otherwise finished across multiple support structures.

To achieve the foregoing objectives, the present invention provides a universal buffing fixture and structure for supporting large and thin metal skins during a finishing operation, which includes: a plurality of individual form fixtures, at least one trunnion table mounted for rotation along a horizontally disposed axis, and a motor for causing the rotation of the trunnion table. Each of the form fixtures is comprised of a frame having at least one brace which extends outwardly from the frame, a form shell mounted to the frame such that the interior surface is in contact with a longitudinal edge of the brace, and a layer of foam disposed substantially along the entire interior surface of the form shell in order to support the surface area of the form shell. The form shell has a three dimensional shape which follows the three dimensional shape of the metal skin to be finished. A set of straps are also provided in order to removably secure the metal skin to the form shell, such that the metal skin lies flush against the exterior surface of the form shell.

In one embodiment according to the present invention, a pair of trunnion tables are provided being positioned to enable exceptionally large metal skins to be supported across both tables. In this regard, the trunnion tables are mounted for rotation along a common horizontal axis, and a pair of servo motors are provided to cause a synchronous rotation of the trunnion tables.

One advantage of the present invention is that the buffing fixture and structure permit the use of one or more robots to finish a plurality of skins supported on the trunnion tables. Another advantage of the present invention is that the trunnion tables may incorporate a second form fixture thereon to allow at least one metal skin supported on one side of the table to be subjected to a buffing operation, while a second metal skin is being mounted to the other side of the trunnion table. Still another advantage of the present invention is that the structure permits a single buffing head per robot to finish the entire skin. A further advantage of the present invention is that the buffing fixture may be repeatedly used to support metal skins having the same shape, thereby insuring greater uniformity among finished skins as well as reducing the likelihood that any metal skin could be deformed during the buffing process due to the pressure exerted upon the skin by the buffing head.

Other objectives, features and advantages of the present invention will be readily appreciated and better understood by referring to the following description and accompanying drawings.

DESCRIPTION OF THE PREFERRED EMBODIMENT

Figures 1A, 1B:
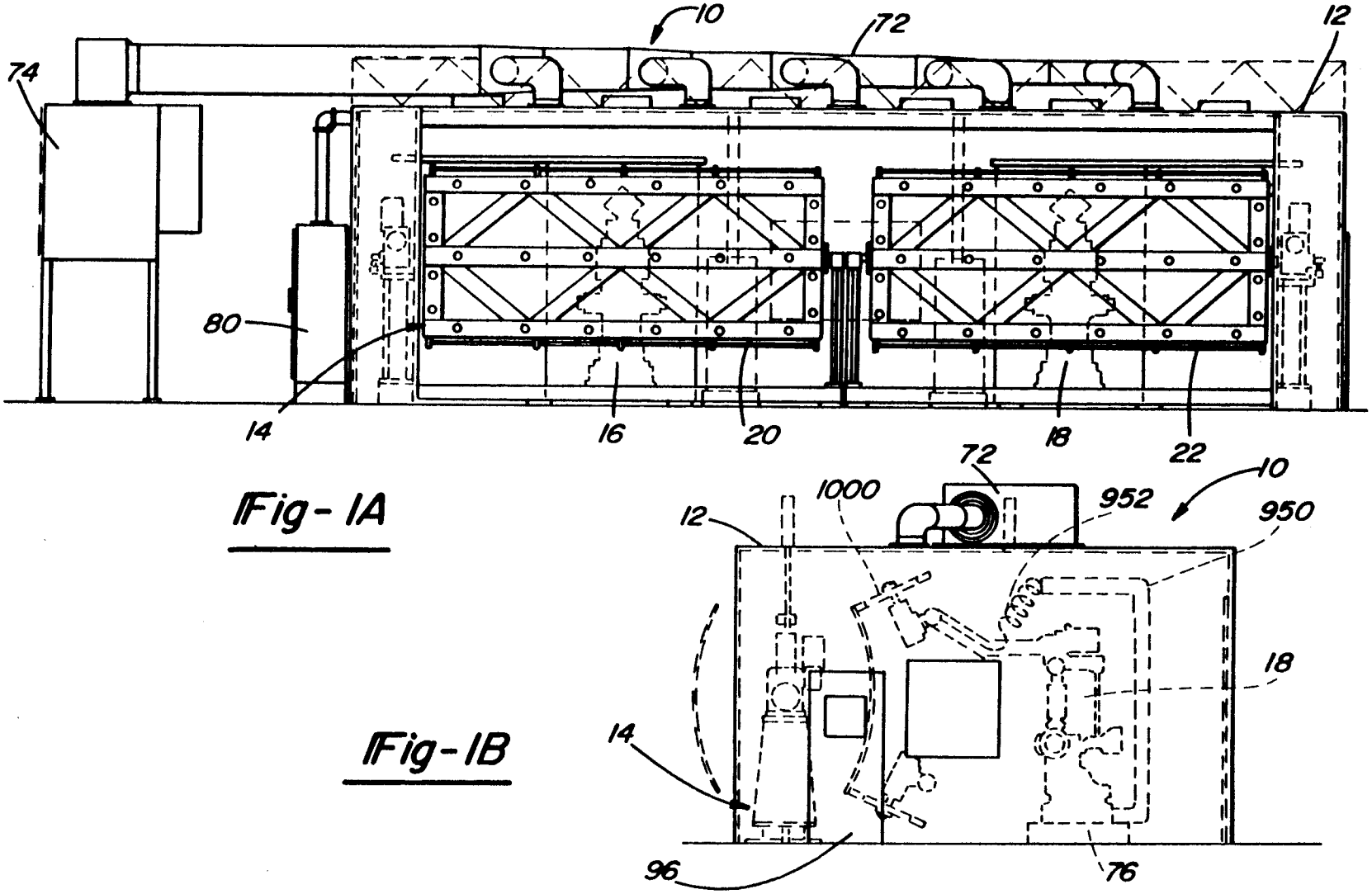
FIG. 1A. is a front elevation view of a finishing cell in accordance with the principles of the present invention.
FIG. 1B is a side elevation view of the finishing cell shown in FIG. 1A.
Figure 1C:
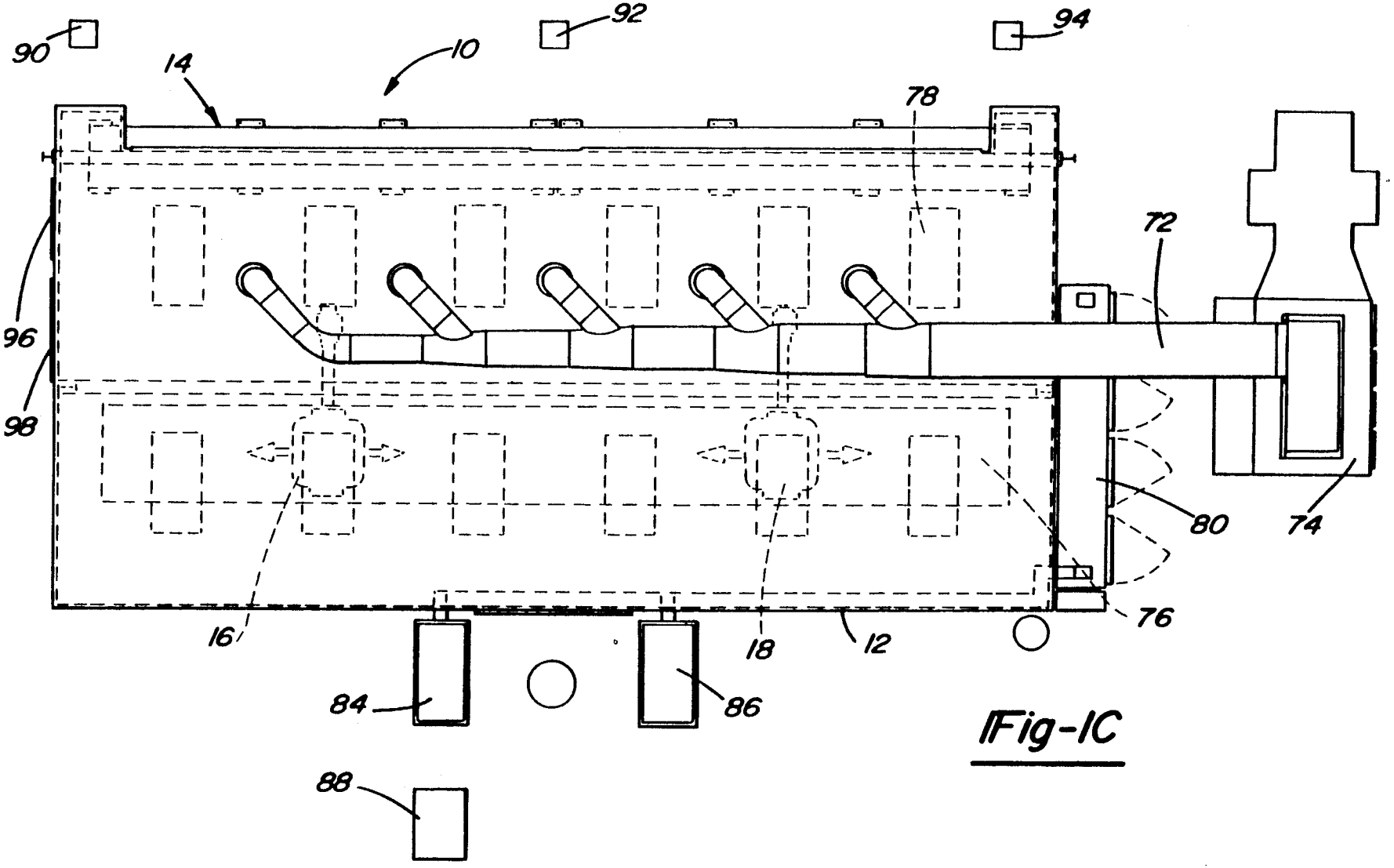
FIG. 1C is a plan view of the finishing cell of FIG. 1A.

Referring generally to FIGS. 1A-1C, a finishing cell 10 according to the present invention is shown. The finishing cell 10 includes an enclosure 12, a trunnion table structure 14, and a pair of robots 16-18 for buffing one or more metal skins supported on the table structure. The table structure 14 includes a pair of trunnion tables 20, 22 which are mounted for rotation along a common horizontally disposed axis. Each of the trunnion tables 20, 22 preferably has one of the robots 16, 18 associated therewith, such that the metal skin(s) supported on the left table 20 will be buffed by the leftmost robot 20. Similarly, the metal skin(s) supported on the right table 22 will be buffed by the rightmost robot 18. However, as will be apparent from the discussion below, an exceptionally large metal skin may be supported across both of the trunnion tables 20-22 to permit simultaneous buffing by the robots 16-18.

As may be best seen in FIG. 1B, the actual buffing process occurs within the interior the finishing cell 10, so as to provide for a controlled environment for the finishing operation. In this regard, FIGS. 1A-1B indicate that the metal skins are preferably buffed while the trunnion tables 20, 22 are disposed in an upright or vertical position. It should also be noted that the table structure 14 permits one or more of the robots 16-18 to buff metal skins supported on the interior facing sides of the tables 20, 22 while other metal skins are being mounted on the exterior facing sides of the trunnion tables in preparation for buffing. This feature increases productivity, as the operators do not have to wait for one set of metal skins to be buffed before mounting a second set of metal skins for buffing.

Figure 2B:
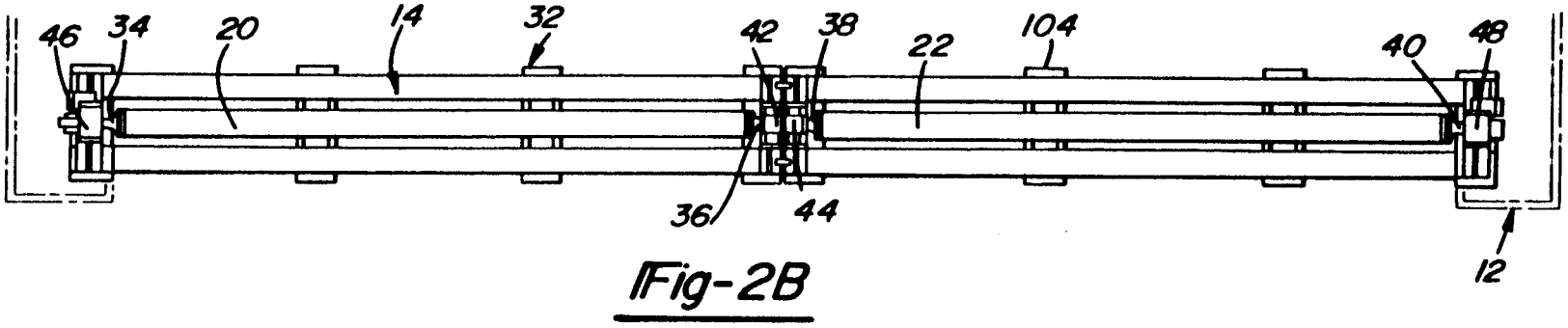
FIG. 2B is a plan view of the trunnion tables shown in FIG. 2A.
Figure 2A:
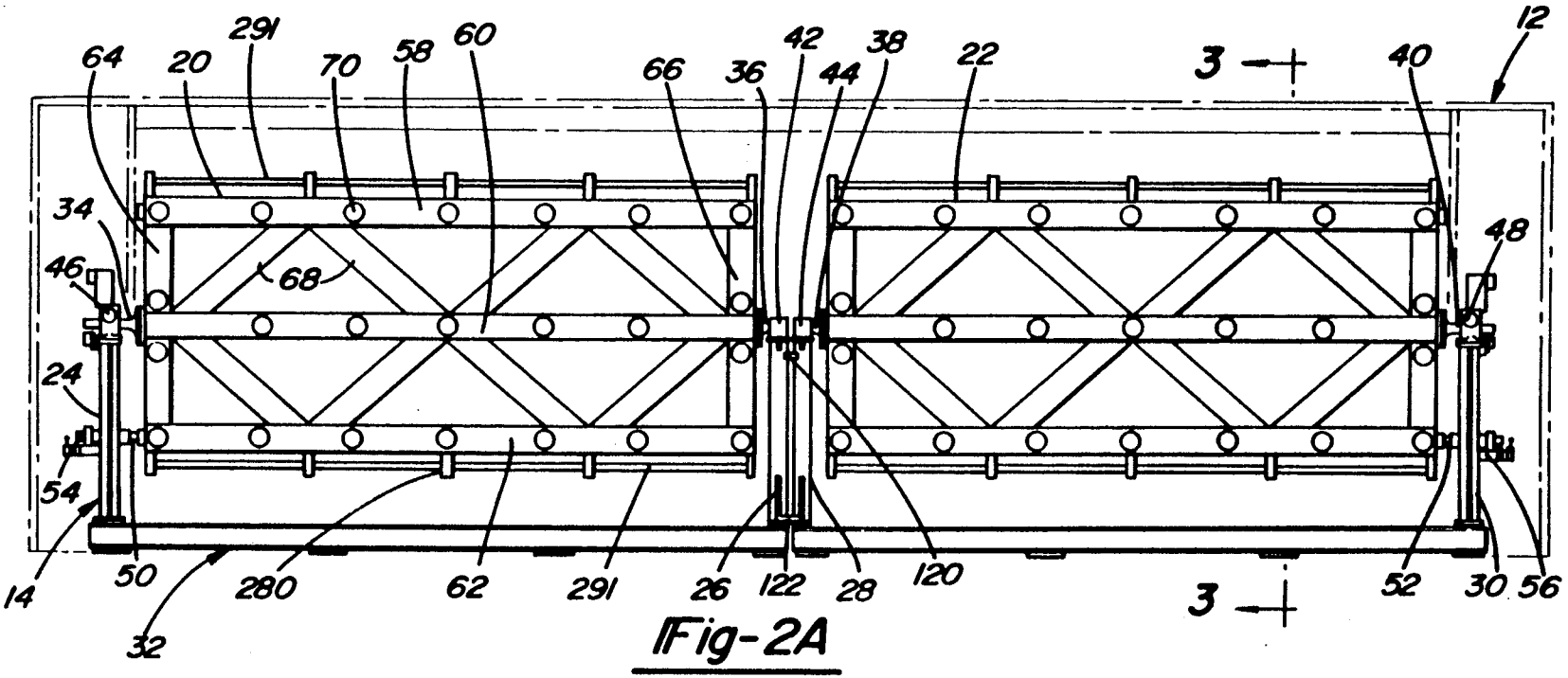
FIG. 2A is a front elevation view of the trunnion tables shown in FIG. 1A.

The table structure 14 itself is shown more clearly in FIGS. 2A and 2B. As may be seen from these figures, each of the trunnion tables 20-22 are supported by a pair of box-shaped beams which are disposed at the ends of the tables. Specifically, the trunnion table 20 is supported by beams 24,26, and the trunnion table 22 is supported by beams 28, 30. These beams are mounted to a base 32 which will be described in connection with FIG. 3. Each of the tables 20-22 are rotatably supported along a common horizontal axis which is defined by the solid steel rods 34-40 extending from the ends of the tables. At the center of the table structure 14, a pair of journal bearings 42-44 permit the rods 36-38 (and hence the tables 20-22) to freely pivot. However, at the outer ends of the table structure 14, a pair of motor/reducer assemblies 46-48 are provided to control the rotation of the rods 34 and 40 (and hence the tables 20-22). In this regard, the motor/reducer assemblies 46-48 are bolted to the top of their respective beams 24 and 30, with the rods 34 and 40 being drivingly connected to their respective motor/reducer assemblies. A sprocket may also be secured to each of the rods 34 and 40 to permit a drive chain link between the rods and suitable rotary limit switches. In one form of the present invention, the motor assemblies 46-48 are each comprised of a model FAS.A2.120.030.1603 brushless servo motor available from Vickers and a model 960 CSD TDM 750:1 gear box available from Winsmith.

In a preferred form of the present invention, the tables 20-22 are rotatable either in unison or individually. In this regard, each of the motor assemblies 46-48 generate a signal which is indicative of the angular position or movement of its respective table to permit coordination or synchronized movement of the tables. Such synchronized movement permits an exceptionally large metal skin to be mounted across both of the tables 20-22, with the tables then being rotated by the motor assemblies 46-48 to flip the metal skins over and into the interior space of the finishing cell 10 for buffing. Accordingly, it should be appreciated that the table structure 14 is designed to permit a 180 degree rotation of the tables 20-22. While it may be appropriate in some applications to provide a full 360 degree rotation, such a provision is not necessary. Once the metal skins have been completely buffed, the rotational direction of the tables 20-22 may simply be reversed to bring the metal skins back to the point where they will be outside of the finishing cell 10.

When the tables 20-22 are in the vertical position, as shown in the figures, locking pins 50-52 are preferably extended into complementary wedge-shaped receptacles which are bolted to the tables. The locking pins 50-52 are extended by pneumatic actuators 54-56. In one form of the present invention, the pneumatic actuators are model 3.25 Bor ex 3" stroke R5A 1.75 ALA actuators available from Hydro-Line. The locking pins serve to prevent the tables 20-22 from rotating during the finishing operation when force is applied to the tables from the buffing heads of the robots 16-18. Additionally, the locking pins also serve to prevent movement of the tables 20–22 when the metal skin carrying fixtures are mounted to the tables.

The rectangular-shaped tables 20–22 themselves are comprised of three horizontally spaced members 58, 60, 62, a pair of vertically-spaced members 64–66 and a set of diagonal support members 68. Each of these members are preferably comprised of box-shaped steel beams. These beams are then welded together to form the skeleton-like structure of the trunnion tables. However, it should be noted that sheet steel panels may be welded to the members 58–68 in order to fill the spaced between these members. FIG. 2A also shows that each of these members are formed with a series of equally spaced mounting pads or hubs 70, many of which have a tapped bolt hole for mounting the metal skin carrying fixtures to be discussed below. Briefly referring also to FIG. 4A for greater detail, the tables 20–22 also have vertical tension bar supports 280 extending upwardly and downwardly from the upper horizontal member 58 and lower horizontal 62, respectively, which support strap tensioning bars 290, 291 that extend the length of the tables. The purpose of the strap tensioning bars 290, 291 will be described in more detail below. The manner in which the buffing fixtures are removably mounted to the tables 20–22 will also be described in more detail below.

Referring again to FIGS. 1A–1C, the enclosure 12 for the finishing cell 10 is shown to include an air plenum 72 and an air handling system 74 (e.g., a Torit 5000 CFM dust collector) connected to the plenum in order to remove particles from the air due to the buffing operation. While the air plenum 72 is shown to extend along the mid-section of the ceiling for the enclosure 12, the air plenum could also be located along the back of the ceiling or any other suitable location as well. Additionally, it may also be advantageous to provide an air return from the air handling system 74 back into the enclosure 12. Within the interior space of the buffing cell, the robots 16–18 travel in a longitudinal path as guided by a common robot shuttle 76 shown in FIGS. 10A–10B. The trunnion tables 20–22 generally define one wall of the enclosure 12. The ceiling of the enclosure 12 is preferably provided with a set of light fixtures 78 to illuminate the work area. An electrical enclosure 80 located at one end of the buffing cell houses the programmable logic controllers and associated circuitry (e.g., motor starters, fuses and transformers) for controlling the motor assemblies 46–48 which cause the rotational movement of the tables 20–22. One or more keypads may be mounted on the doors of the electrical enclosure 80 (or along the back wall of the enclosure 12) to provide communication with these programmable logic controllers. On the wall opposite the trunnion tables 20–22, a viewing port 82 is provided to allow an operator to program the various movements of the robots 16–18 using a teach pendant. FIG. 1C also shows that a pair of computer-based controllers 84–86 are provided for directing the programmed movements of the robots 16–18. A host controller computer 88 may also be provided for interconnecting the controllers 84–86 with the programmable logic controllers contained in the electrical controller 80. In one form of the present invention, the host controller computer is comprised of a Xycom model 4190 computer system, and the programmable logic controllers are model 2/17 controllers from Allen-Bradley. As the robots 16–18 are GMF S-420F robots in one form of the present invention, the robot controllers are preferably GMF Karel S-420F controllers.

FIG. 1C also shows that the finishing cell is preferably equipped with three movable (pedestal based) operator stations 90–94. These operator stations include a set of push button actuators which enable the operators to initiate a buffing cycle or otherwise control the movement of the tables 20–22. Specifically, the station 90 is used to control the buffing operation with respect to the trunnion table 22, while the station 94 is used to control the buffing operation with respect to the trunnion table 20. The third station 92 includes actuators for controlling the buffing operation with respect to both trunnion tables 20–22, either individually or in a tandem mode.

FIG. 1B also shows an access door 96 to allow operator entry into the finishing cell 10 for purposes of performing maintenance and the like. While not shown, one or more sliding doors could be located along the back wall of the enclosure 12 to permit access by a fork lift. An additional viewing port 98 is provided near the service entry door 96. While not shown in FIG. 1A–1C, it may be advantageous to provide one or more buffing compound storage vessels and spray assemblies for enabling the distribution of buffing compound over the surface of the metal skins to be buffed. While the buffing compound could be applied by the robots 16–18, the application of a layer of buffing compound to the surface of the skins by other suitable means has the advantage of avoiding the addition of unnecessary weight to the robot arms. Additionally, while not shown in these figures, the finishing cell 10 is also preferably provided with a one-ton crane assembly which extends outwardly from the top of the enclosure 12 to facilitate the movement of the metal skin carrying fixtures to and from the tables 20–22.

Figure 3:
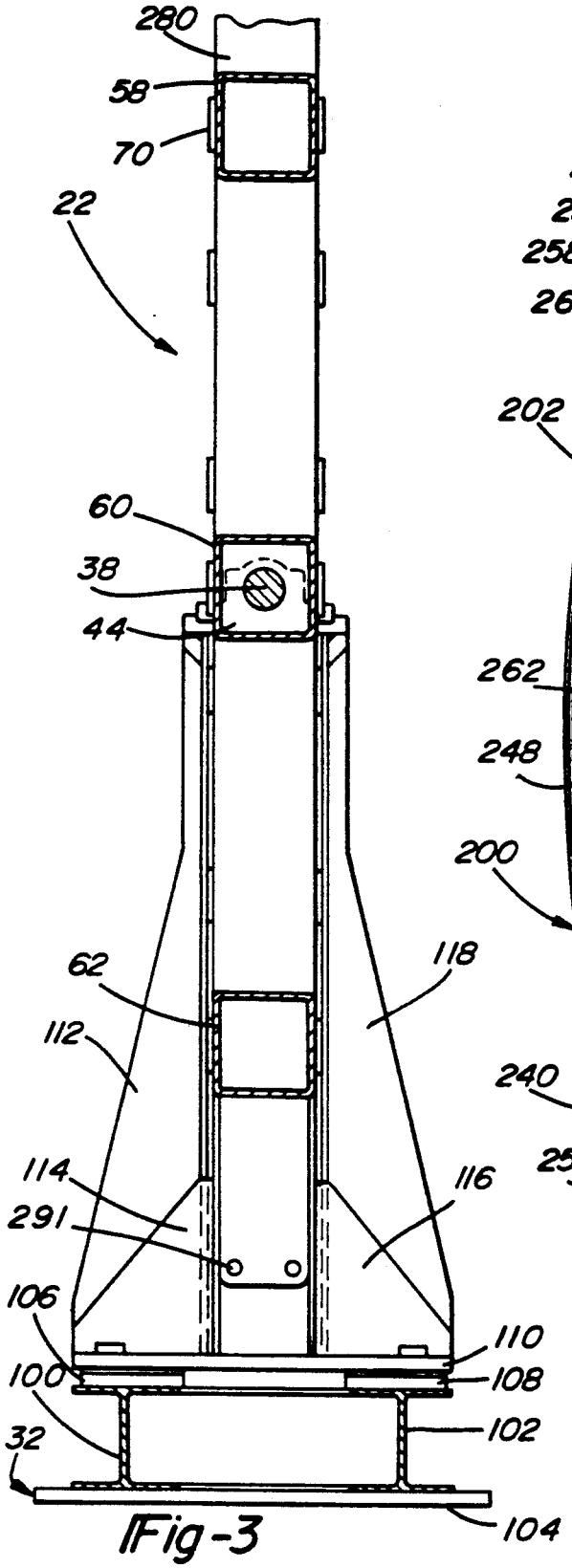
FIG. 3 is a cross-sectional view of one of the trunnion tables shown in FIG. 2A the section being taken along line 3—3 thereof.

Referring to FIG. 3, a cross-sectional view of the trunnion table 22 is shown. In this regard, it should be noted that FIG. 3 illustrates the box section members 58 and 62, the journal bearing 44 and the mounting pads 70, which have been discussed above. FIG. 3 also illustrates the welded construction of the base 32 for each of the trunnion tables 20–22. As shown, the base 32 includes a pair of parallel I-beams 100–102 which run the length of the tables. The I-beams 100–102 are sandwiched between a lower base plate 104 and a pair of mounting plates 106–108. As may be best seen in FIG. 2B, a plurality of lower base plates 104 are preferably provided at spaced locations along the I-beams to serve the function of feet for the table structure 14. An upper base plate 110 is bolted to the mounting plates 106–108. A plurality of vertically extending bracket members 112–118 are also welded between the upper base plate 110 and the beam 28 to provide further stability. As may be best seen in FIGS. 2A–2B, a plurality of connector plates 120–122 are welded to the beams 26–28 in order to join the beams 26–28 together and provide overall stability for the table structure 14.

Figure 4A:
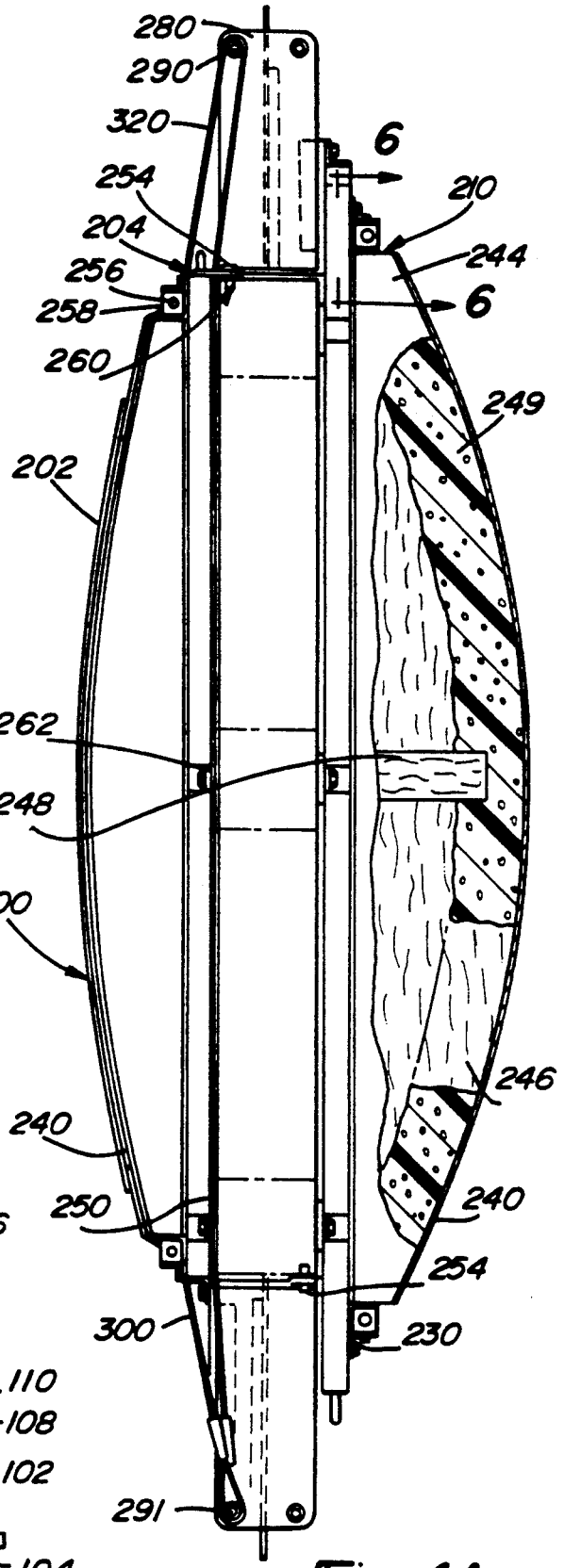
FIG. 4A is a side elevation view of a buffing fixture according to the present invention with a partial cut away to illustrate the under construction of the buffing fixture, which is shown mounted to the support structure of FIGS. 2A and 3.
Figure 4B:
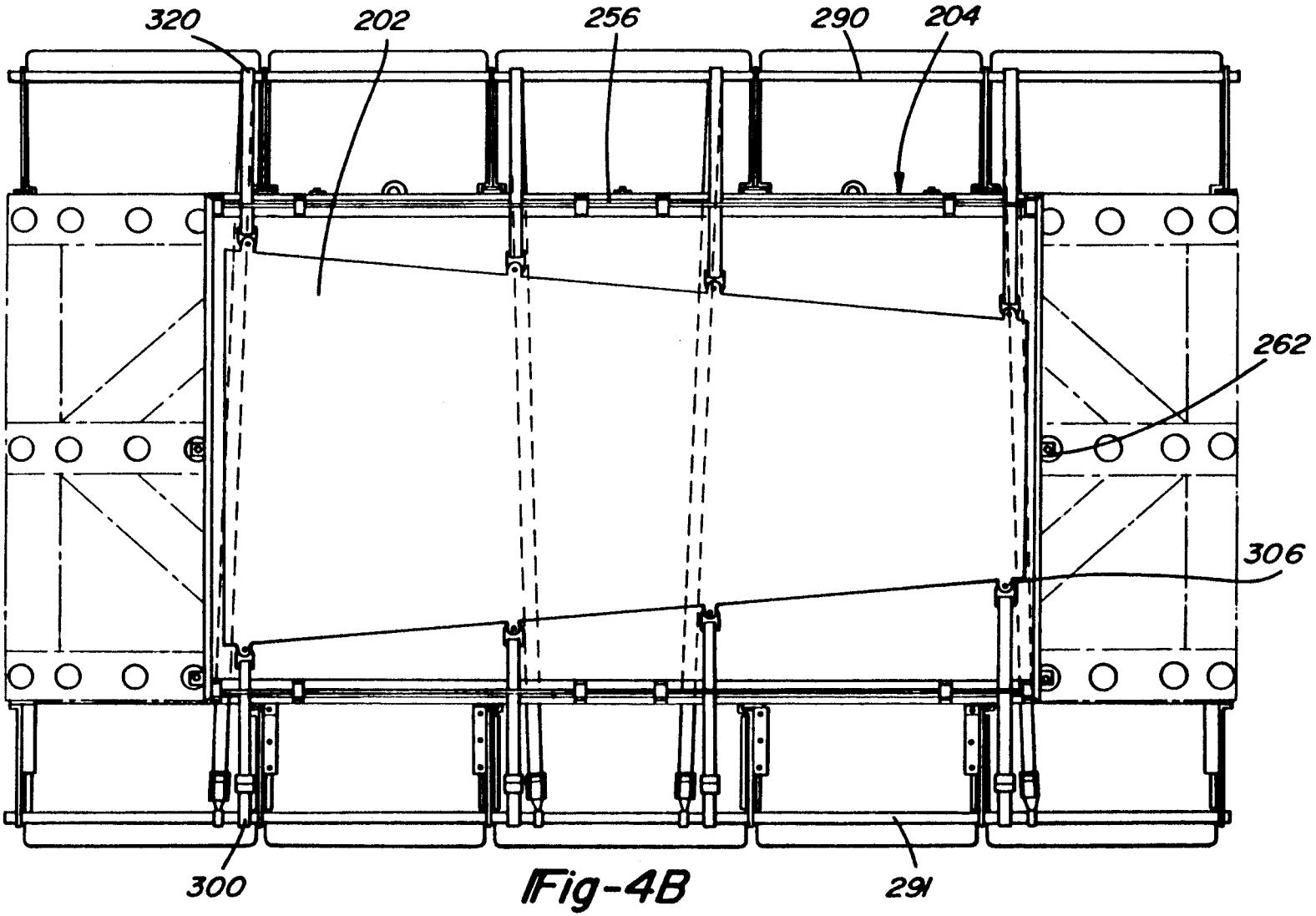
FIG. 4B is a front elevation view of the buffing fixture shown in FIG. 4A.
Figure 5:
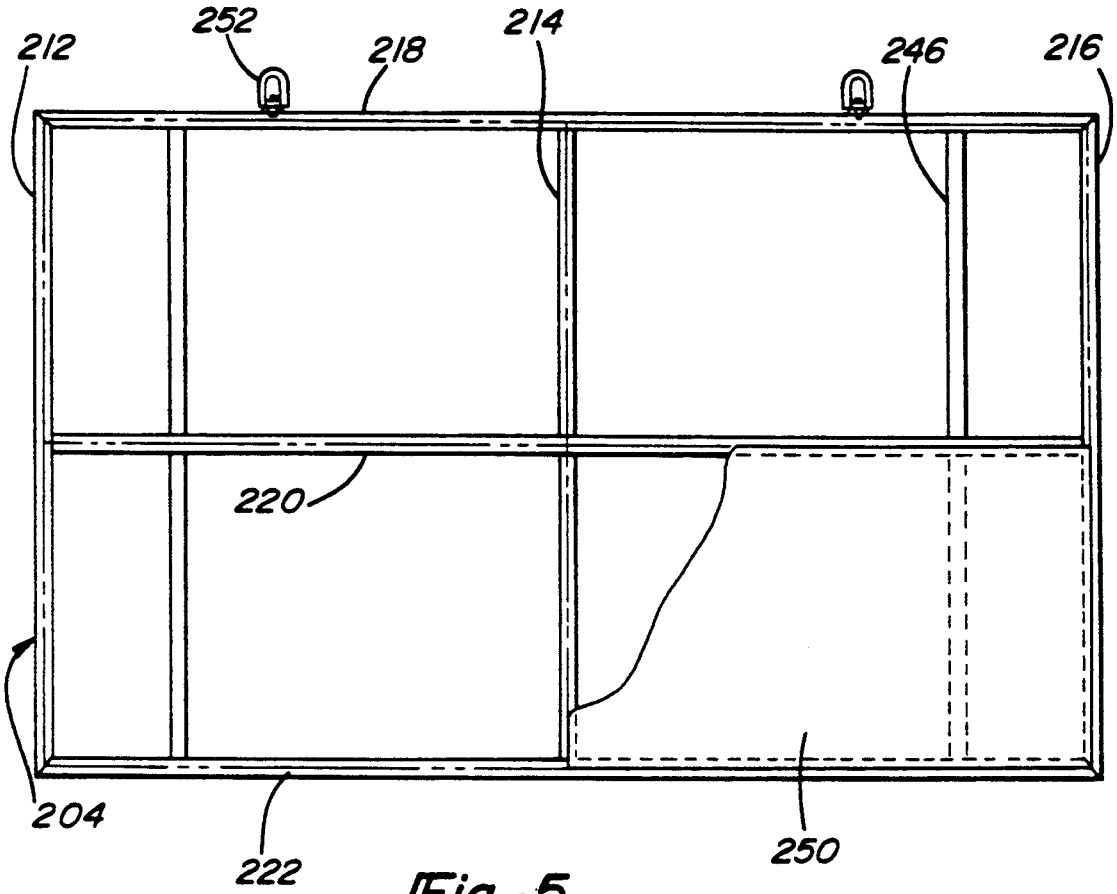
FIG. 5 is a rear elevation view of the frame for the buffing fixture shown in FIGS. 4A-4B, with most of the backing plate cut away to provide detail of the under construction.
Figure 6:
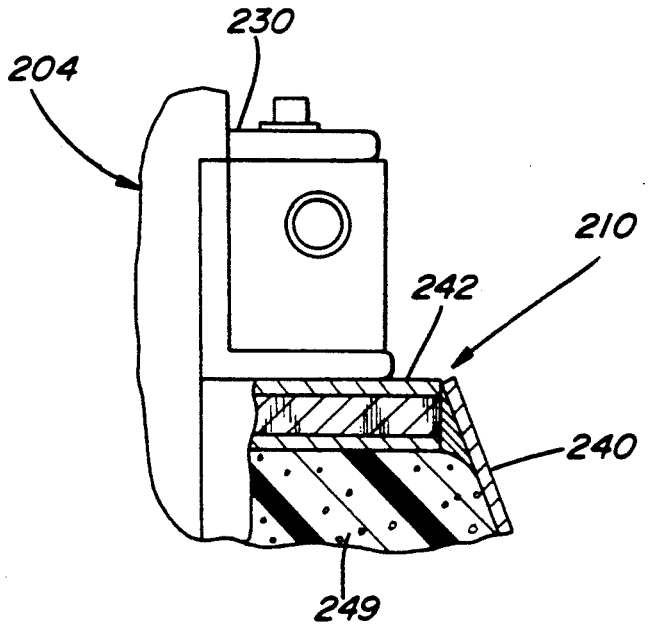
FIG. 6 is a cross-sectional view of the buffing fixture shown in FIGS. 4A-4B, the section being taken along line 6—6 of FIG. 4A.
Figure 7A:
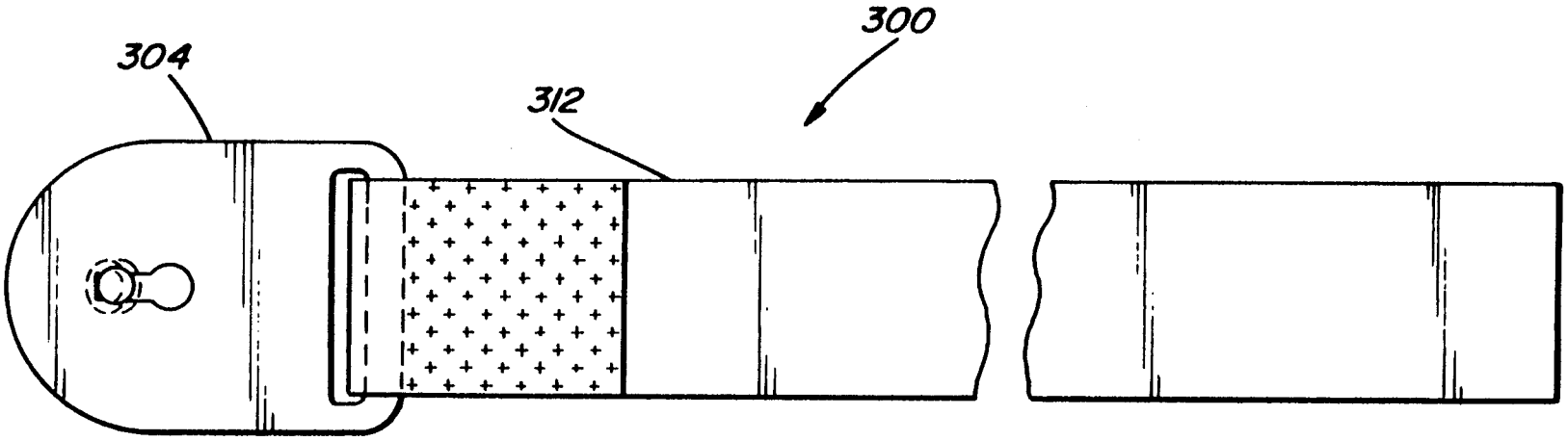
FIG. 7A is a plan view of the registration strap shown in FIG. 4B.
Figure 7B:
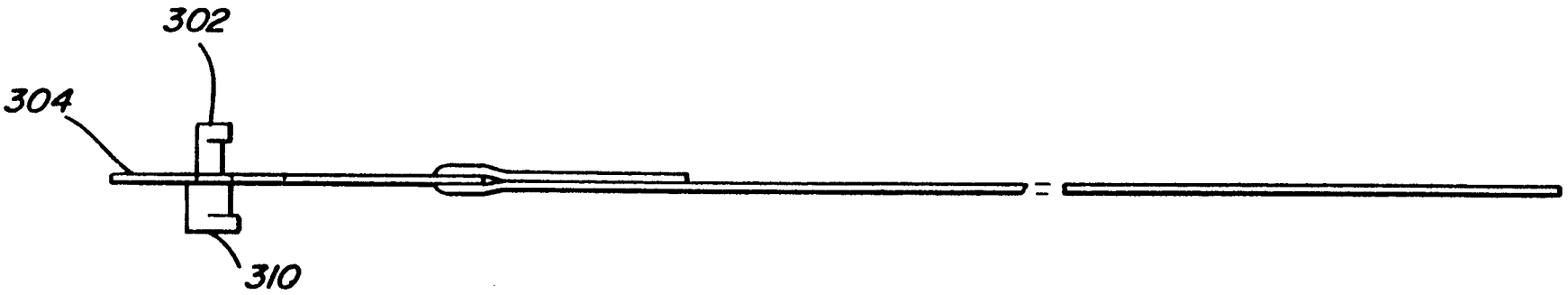
FIG. 7B is a side elevation view of the registration strap shown in FIG. 7A.
Figure 8A:
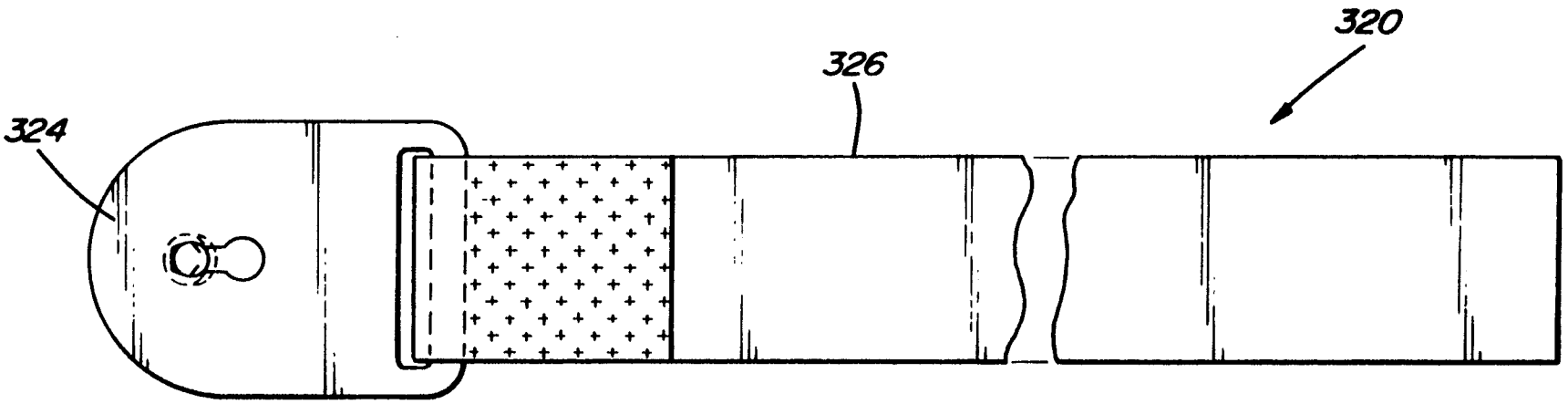
FIG. 8A is a plan view of the standard strap shown in FIG. 4B.
Figure 8B:
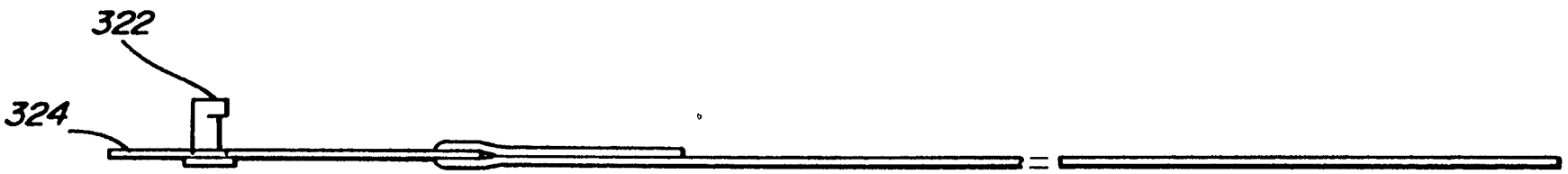
FIG. 8B is a side elevation view of the standard strap shown in FIG. 8A.

Referring generally to FIGS. 4A–4B, 5 and 6, a buffing fixture 200 according to the present invention is shown. FIGS. 4A–4B show two elevation views of an airplane skin 202 which is removably supported on the buffing fixture 200, while FIG. 5 shows the frame for the buffing fixture 200 in more detail. FIG. 6, on the other hand, shows a cross-sectional view of the buffing fixture 200.

The buffing fixture is generally comprised of a rectangular frame 204 upon which is mounted a shell master 210. The frame is made up of vertical members 212–216 and horizontal members 218–222, all of which are 2"×2" square steel tubing secured together by welds. The shell master 210 is attached to the rectangular frame 204 by way of shell mounting brackets 230 and bolts. The shell mounting brackets 230 have slotted holes so as to act as a slip joint. This facilitates mounting the shell master 210 to the rectangular frame 204 despite the fact that the rectangular frame 204 may be slightly out of square. Once the shell master is bolted to the rectangular frame 204, it can be further secured by welding the shell master framework to the rectangular frame 204.

Referring specifically to FIGS. 4A and 6, the construction of the shell master 210 is described in greater detail. Specifically, the shell master is comprised of a shell 240 mounted to a shell frame. The shell master framework is comprised of 3"×3"×½" angle iron welded into a rectangular shape, the angle iron having periodic holes or slots drilled through it such that the angle iron serves as both the shell frame and, via shell mounting brackets 230, the shell mounting means. Adjacent to the upper and lower interior surfaces of the shell master framework, and running the length of the frame, are shell mounting rails 242 made up of an aluminum honeycomb material comprised of two sheets of aluminum with honeycomb material expanded between the sheets. The shell itself 240 is ⅛ inch aluminum having a three-dimensional curvature similar to that of the skins which will eventually be mounted on the shell master 210. As such, the shape of the shell is dictated by customer needs. The upper and lower edges of the shell 240 are attached to the shell mounting rails 242 using sheet metal screws. As an alternative, the shell 240 can be attached to the shell mounting rails 242 by means of an adhesive, which can be used alone or in conjunction with the screws. To enclose the shell master 210, a plurality of ribbed braces are provided. Specifically, there are end rib braces 244 at either outer edge of the shell 240 and inner stiffening rib braces 246 spaced throughout the mid section of the shell 240. The end and inner ribbed braces have exterior contoured surfaces designed to mate to the contour of the shell 240. In order to properly contour the rib braces, CAD data describing the contour of the shell 240 can be periodically cross-sectioned producing a "slice" whose outer contour is identical to the contour of the shell 240 at the point at which that cross section was taken. The rib braces 246 can thereby be patterned after the cross sectional slices. To maintain spacing between the rib braces as well as to provide additional structural strength, stringers 248 are placed horizontally between the vertical rib braces. It should be noted that it is not necessary for the stringer to actually contact the surface of the shell 240, and as such can be fabricated without resorting to CAD data. The end rib braces 244 are aluminum, while the inner rib braces and stringers can be made simply of plywood or any other suitable material.

The shell master 210 is constructed as follows: the shell 240 is attached to the shell mounting rails 242 and the end rib braces are fastened in position; the plywood skeleton comprised of the inner rib braces 246 and stringers 24 is then placed inside the cavity of the shell 240; next, foam 249 is applied across the inner surface of the shell 240 to form a stiffening coating, and is preferably high density foam applied to a thickness of 4 inches the foam commercially available; the foam 249 molds to the contour of the shell 240, as well as conforming around the rib and stringer skeleton, so as to provide added strength for the shell and to secure the skeleton in place; the shell master is then mounted to the rectangular frame 204 as was described earlier; finally, a backing plate 250 is placed over the rectangular frame so as to enclose the foam and stringer under-support structure. The backing plate is preferably 16 gauge sheet steel and is secured to the rectangular frame using welds. As constructed, the buffing fixture is lightweight, strong, and custom-contoured to accommodate the skins to be buffed so as to support the skins during the buffing process and alleviate distortion of the skins.

It should also be noted that the buffing fixture 200 has carrying eyes 252 located along the upper edge of the rectangular frame 204. These carrying eyes 252 are provided so that the buffing fixture 200 can be lifted and carried by the overhead crane. Also, hanging pins 254 are located along the upper edge of the rectangular frame. These hanging pins 254 extend outwardly towards the back of the buffing fixture 200 and are used to mount the buffing fixture on both the trunnion table and the fixture dolly. (The fixture dolly will be described later). It should also be noted that the buffing fixture 200 has upper and lower strap guide bars 256 which are fastened to the upper and lower angle iron of the cell mounting frame via end block 258. The end blocks 258 ar fastened to the angle iron using welds and the strap guide bars are fastened within the end blocks using welds as well.

Referring specifically to FIG. 4A, the trunnion tables 20 and 22 having alignment holes 260 along the outer surface of the upper and lower horizontally spaced members 58 and 62. These alignment holes 260 are located so as to coincide with the hanging pins 254 of the buffing fixture 200. Referring to FIGS. 3 and 4A, each of the left sides of the drawing figures represent the outside of the buffing cell enclosure and the right side of the respective drawing figures represent then inside of the enclosure. Given this orientation, the alignment holes 260 are located along the upper left and lower right edges of the horizontal brace members 58 and 62. As such, the buffing fixture 200 can be lowered by the crane and hung on the trunnion tables by placing the hanging pins 254 into the alignment holes 260. It can be appreciated that when the table is rotated 180 degrees the alignment holes previously located in the lower right would be in the upper left position and thereby accessible for hanging a buffing fixture from them.

When a buffing fixture 200 is hung on the trunnion table, its position is secured to the trunnion table by bolting into the mounting pads 70. Specifically, the fixture 200 has fixture mounting tabs 262 located along the outer edges of the buffing fixture 200 through which a bolt is secured to the trunnion table mounting pad 70. By bolting the buffing fixture 220 to the table, the fixture is securably retained throughout the rotation of the trunnion table.

Referring to FIGS. 7A–7B and 8A–8B, several views of the registration straps 300 and the standard straps 320 are shown. Referring also to FIGS. 4A and 4B, the registration strap 300 has a skin indexing pin 302 on the registration buckle 304 which engages the mounting tabs 306 of the skin. The registration strap 300 also has a shell registration pin 310 opposite the skin indexing pin 302 on the registration buckle 304 which is inserted into registration holes on the shell. Thus, by registering the registration pin 310 into the fixture shell and indexing the indexing pin 302 into the skin mounting tabs 306, the position of the skin on the shell master is determined.

Figure 9B:
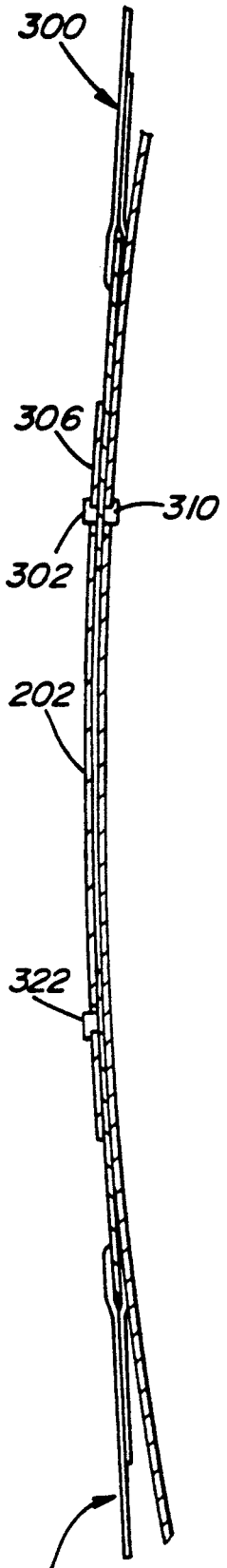
FIG. 9B is a cross-sectional view showing a metal skin removably secured to the buffing fixture by the registration strap of FIGS. 7A-7B and the standard straps of FIGS. 8A-8B.
Figure 9A:
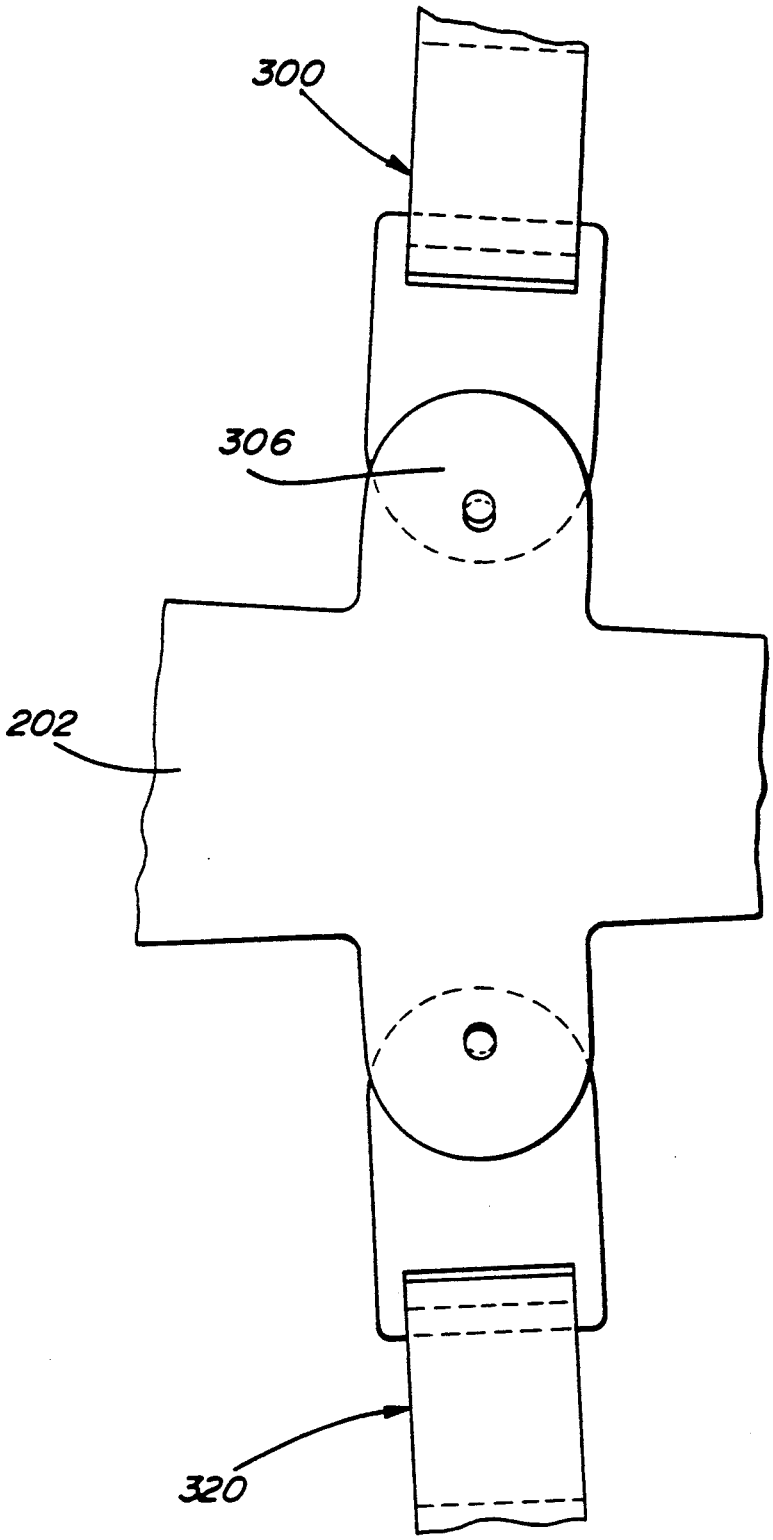
FIG. 9A is a plan view.

To prevent the skin from shifting once registered on the shell master, the registration strap 300 has strapping material 312 attached to the registration buckle 304. The strapping material is laced underneath the lower strap guide bar 256 on the buffing fixture down to the lower trunnion table's strap tensioning bar 291 where it is snugged. A standard strap 320 is provided as well. The standard strap 320 has a skin indexing pin 322 protruding from the standard buckle 324. The skin indexing pin 322 is inserted into the upper mounting tabs 306 of the skin. The standard strap has strapping material 326 attached to the standard buckle 324. The strapping material is laced underneath the upper strap guide bar 256 of the shell master, wraps around the upper strap tensioning bar 290, and down to and around the lower strap tensioning bar 291 where it is snugged. The strapping is snugged using a ratchet commercially available from Kinedyne. In practice, the standard strap is already laced around the upper and lower strap tensioning bars 290, 291 and left dangling in anticipation of mounting skins. Thus, the skin to be buffed is held in place on the shell master, and consequently the trunnion table, by registering the upper edge of the skin using the registration straps 300 and is tensioned in place by the standard strap 320 along the lower edge of the skin. As shown in greater detail in FIGS. 9A and 9B, the skin 202 is registered to the shell 240 by way of the registration pin 310 and the indexing pin 302 of the registration strap 300 and is held in place in tension by way of the standard strap 320 whose indexing pin 322 is inserted into the skin mounting tab. It can be appreciated that registering the position of the skin on the shell master provides for repeat ability by insuring proper placement of the skins on the master as well as insuring the skin does not shift during the buffing process. For example, it may be desirous to buff several skins having the identical shape. The registration of the skins on the cell master allows the operator to buff these identical skins in an identical manner.

Figure 10A:
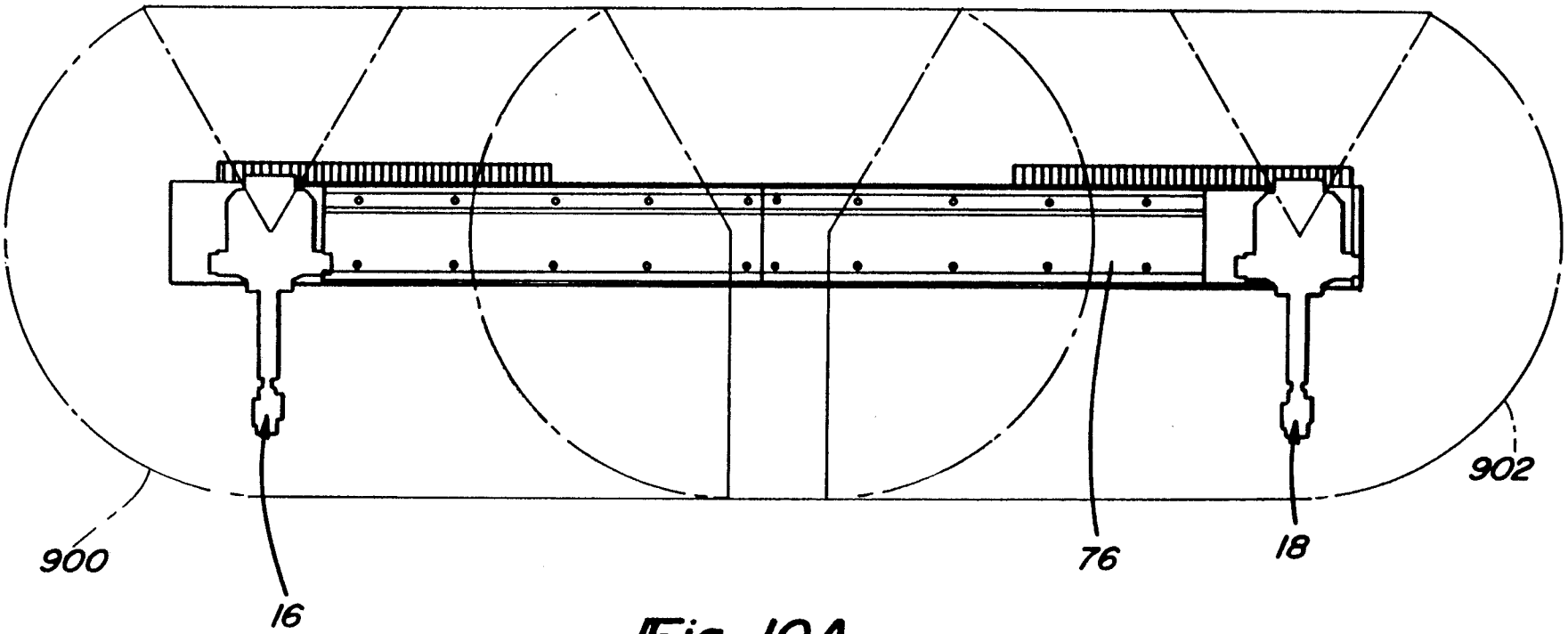
FIG. 10A is a plan view of the robots shown in FIG. 1A.
Figure 10B:
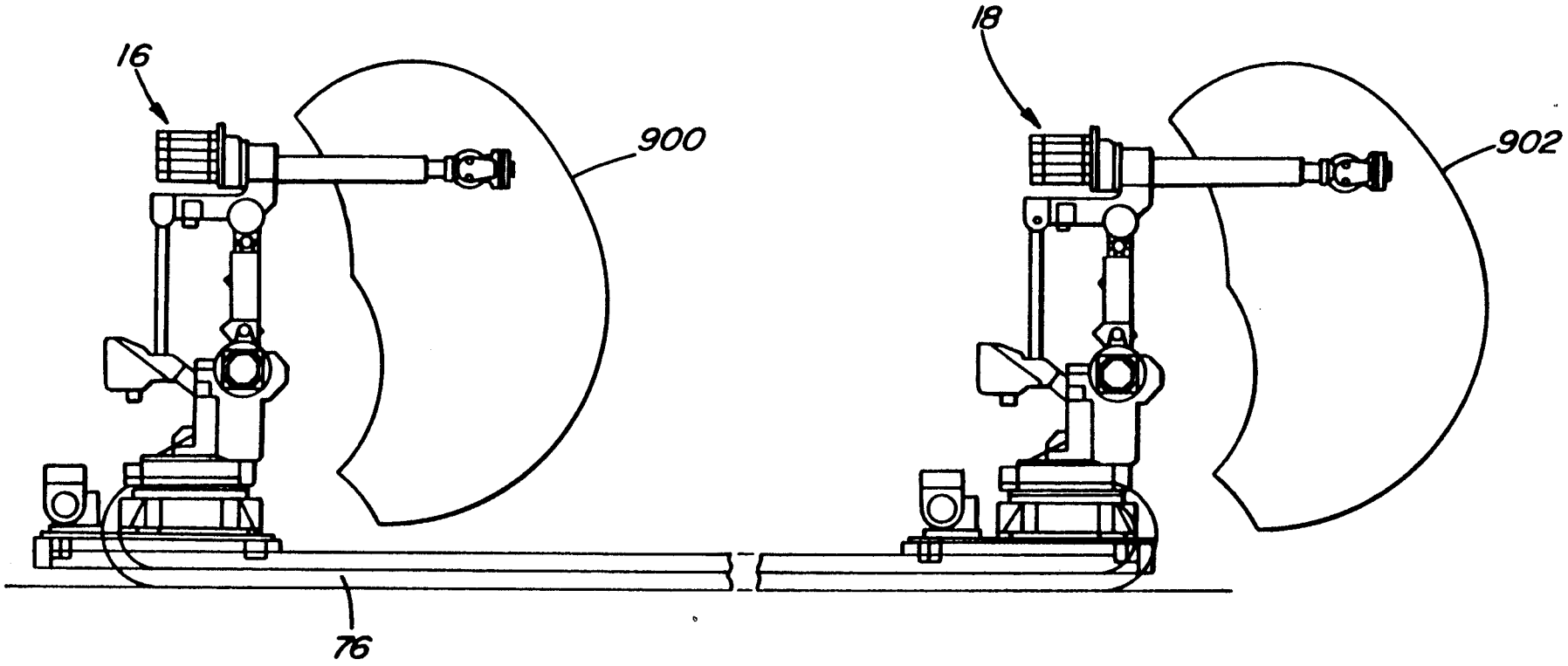
FIG. 10B is a rear elevation view of the robots shown in FIG. 10A.

Referring to FIGS. 10A–10B, two elevation views of the robots 16–18 are shown. In particular, the robots 16–18 are shown to be mounted on the common robot shuttle 76. In one form of the present invention, the robot shuttle 76 is a model 1000 shuttle assembly from Robotic Components of Iowa. The phantom lines 900 and 902 generally describe the sweep, or coverage, area of the robots and buff heads. Referring briefly to FIG. 1B, it can be appreciated that the robots are able to articulate the control arm and buff head attached to the control arm so as to buff the entire surface of any skin mounted on the trunnion tables. More particularly, as can be seen in FIG. 10A, while the robot is stationary it has a sweep area limited to the radial reach of the control arm. Therefore, in order to buff the entire length of the skin, it is necessary for the robot to travel horizontally along the robot shuttle track 76. In order to simplify the robot control programming process, one could symbolically designate the length of the common robot shuttle 76 into sequential zones. By doing so, the robots can be programmed to buff the entire section of skin, from top to bottom, immediately adjacent to any given zone. Once done buffing the skin within that zone, the robot could then move on to the next zone to continue the buffing process.

Referring again to FIG. 1B, each of the robots are shown (in phantom) to include a buff head 1000 to be described below. Additionally, a travelling boom mechanism 950 is also shown as a way to connect electrical power to the electric motor which forms part of the buff head. In this regard, the boom mechanism carries a cable 952 which transmits electrical power to the buff head motor without interfering with the operation of the robot.

Referring generally to FIGS. 1A, 1B, 10A and 10B, an operator would need to initially "teach", or program, the robots the necessary sequence of movements in order to buff the skins. Specifically, an operator could stand outside the cell and operate the computer based controllers 84–86 and the host controller computer 88 while viewing the movement of the robots through the viewing port 82. During the teaching process, it would likely be advantageous to overlay a numbered grid over a buffing fixture mounted on the trunnion table. The numbered grid is used to aid in the programming process. As was mentioned earlier, the host controller can be configured to electronically link the computer based controllers 84–86, and the programmable logic controllers from the electrical controller 8 which controls the movement of the table. By doing so the operator could program not only the movement of the robots but the rotation of the table in conjunction so as to more fully automate the process.

Figure 11A:
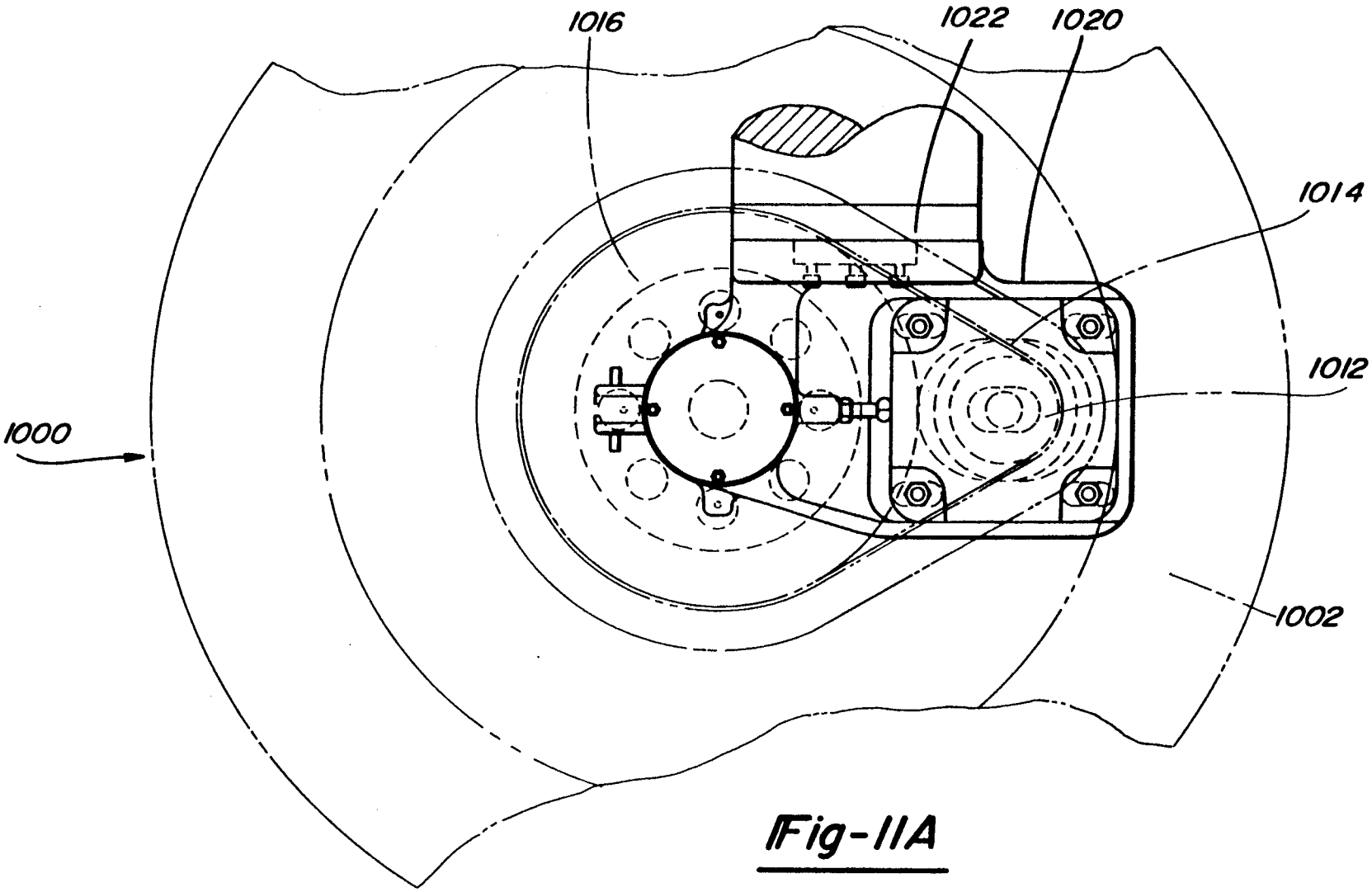
FIG. 11A-11C show three views of the buffing head assembly for the robots shown in FIG. 1B.
Figure 11B:
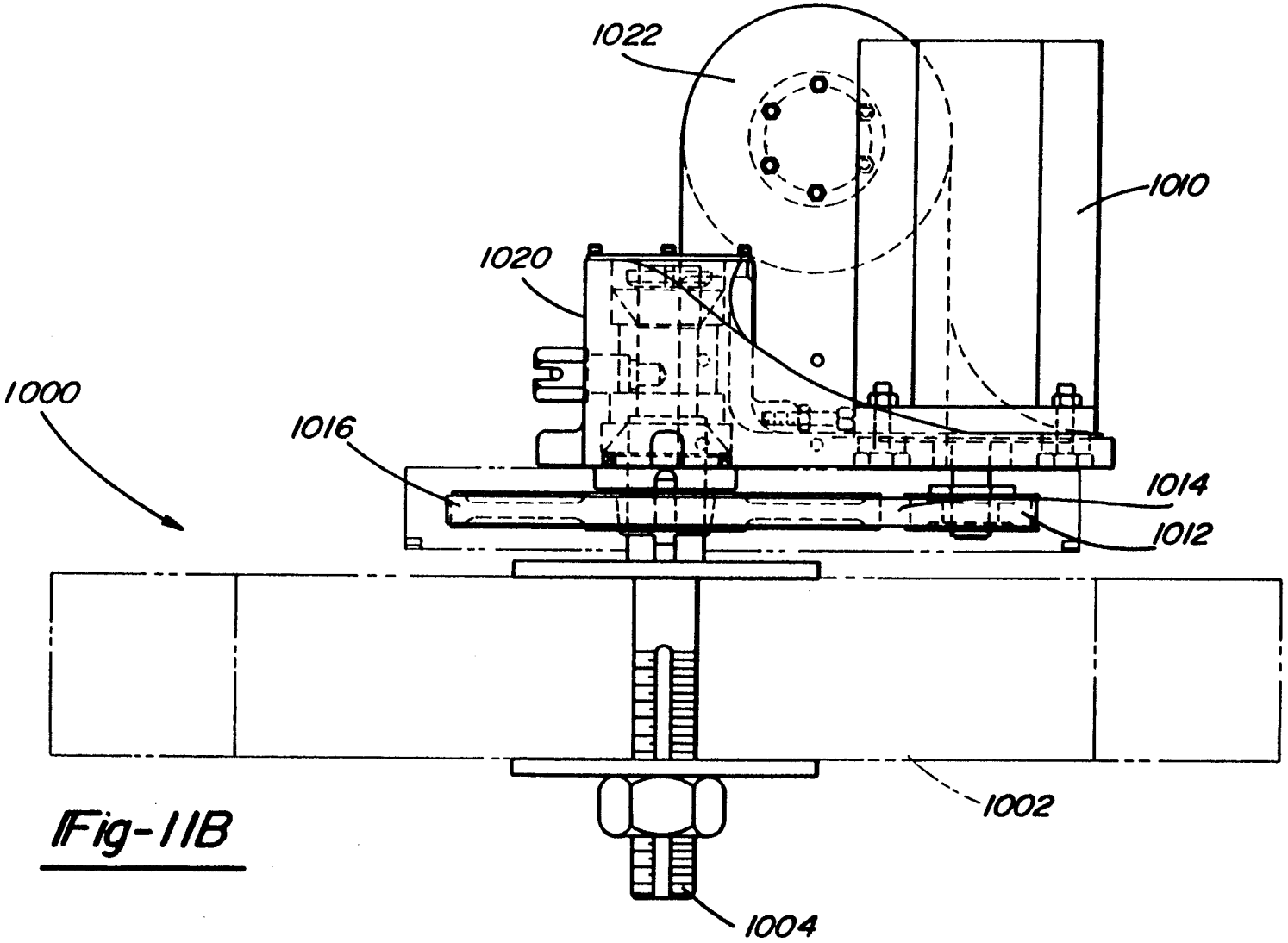
Figure 11C:
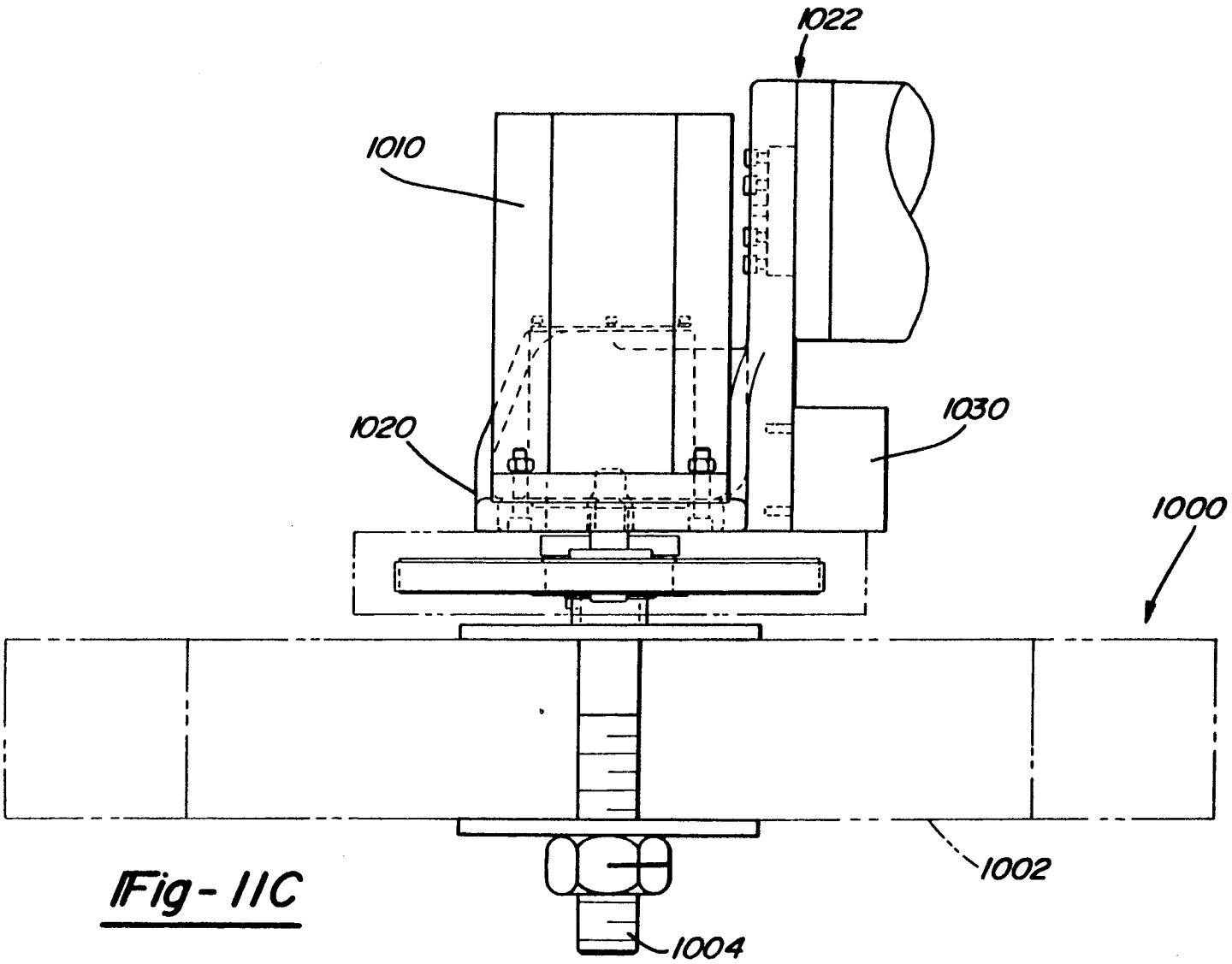

The buff head 1000 itself is shown in greater detail in FIGS. 11A–11C. The buff head itself is generally comprised of a buff wheel 1002 (e.g., up to 40" diameter) which is rotated by a buff head mechanism. The buff head mechanism is bolted to the arm of the robot, therefore allowing the robot to move the buff head in and out of contact with the airplane skin.

More particularly, the buff wheel 1002 is mounted to the buff head mechanism on a threaded mounting shaft 1004, and it is secured by a nut. The buff wheel is powered by an electric motor 1010, the motor 1010 outputting torque which is transmitted by a tensioning pulley 1012 to a belt 1014, to a main pulley 1016 which rotates the buff wheel mounting shaft 1004. The pulley and belt mechanism is protected within a buff head housing 1020. The housing 1020 not only serves to protect the buff head mechanism, but also serves as a fixture upon which to mount the motor 1010 as well as providing an arm coupling plate 1022 so that the buff head mechanism can be bolted to the arm of the robot. It should be appreciated that, in addition to being able to move the buff head in and out of contact with the skin, the robot can also be configured to control the operation of the motor which drives the buff head. Furthermore, the buff head assembly also includes a vibration sensor 1030 mounted to the housing 1020 which monitors the movement of the buff head assembly. The sensor is preferably a 24 volt sensor commercially available. If the buff head assembly were to begin vibrating beyond an initial set point, as could occur if the buff wheel 1002 were unevenly worn so as to throw the buff head mechanism out of balance, the sensor 1030 generates a warning signal which could be coupled to either warning lamps on the control panel to alert the operator and/or transmitted to the robot's controller for a similar warning display. Then, should the vibration increase so as to exceed a second set point, the sensor 1030 generates a signal which will cause the robot to shut down.

In addition, because the buff wheel 1002 is driven by an electric motor 1010, the current draw of the motor, being directly proportional to the force exerted on the buff wheel as it contacts the buffing surface, provides an advantageous way of accurately monitoring the pressure exerted by the buff wheel upon the buffing surface. As discussed earlier, this form of the invention utilizes an electric motor. While a hydraulic motor could be used instead of an electric motor for the buff head, the electric motor has the monitoring advantage noted above, as well as the ability to compensate for variations in loading by easily changing the speed of the motor. Additionally, while not shown in the drawings, a photocell could be coupled to the buff head to provide a way of determining the wear on the buff wheel.

Figure 12A:
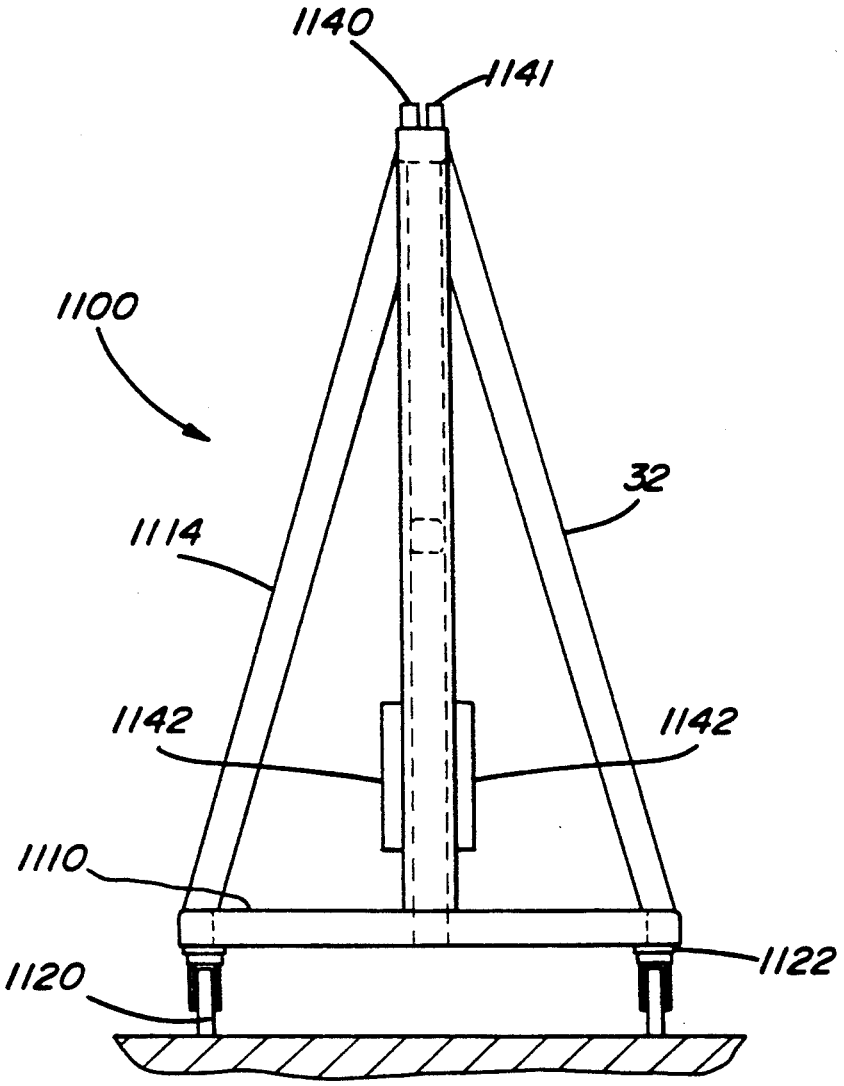
FIGS. 12A-12C show three views of the buffing fixture dolly used to convey the buffing fixtures to and from the buffing cell of FIG. 1A.
Figure 12B:
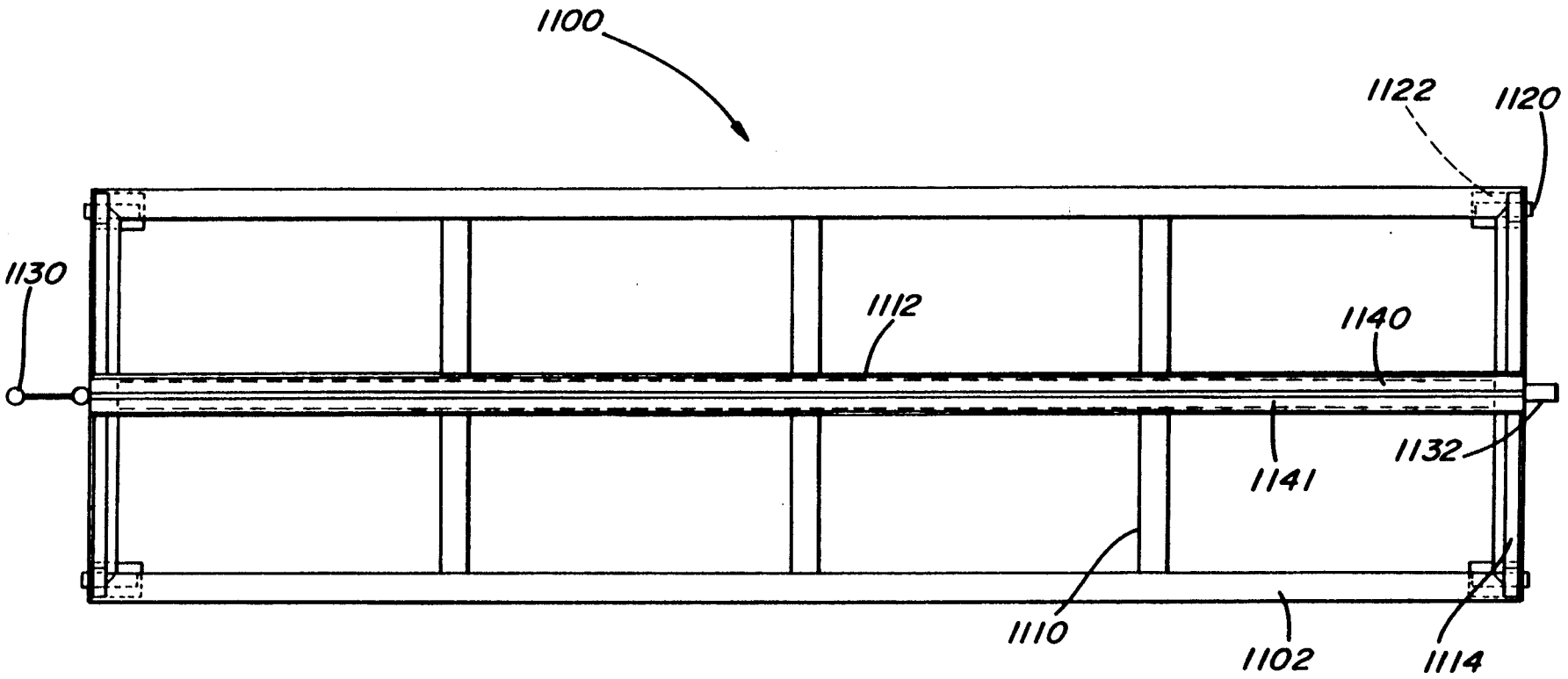
Figure 12C:
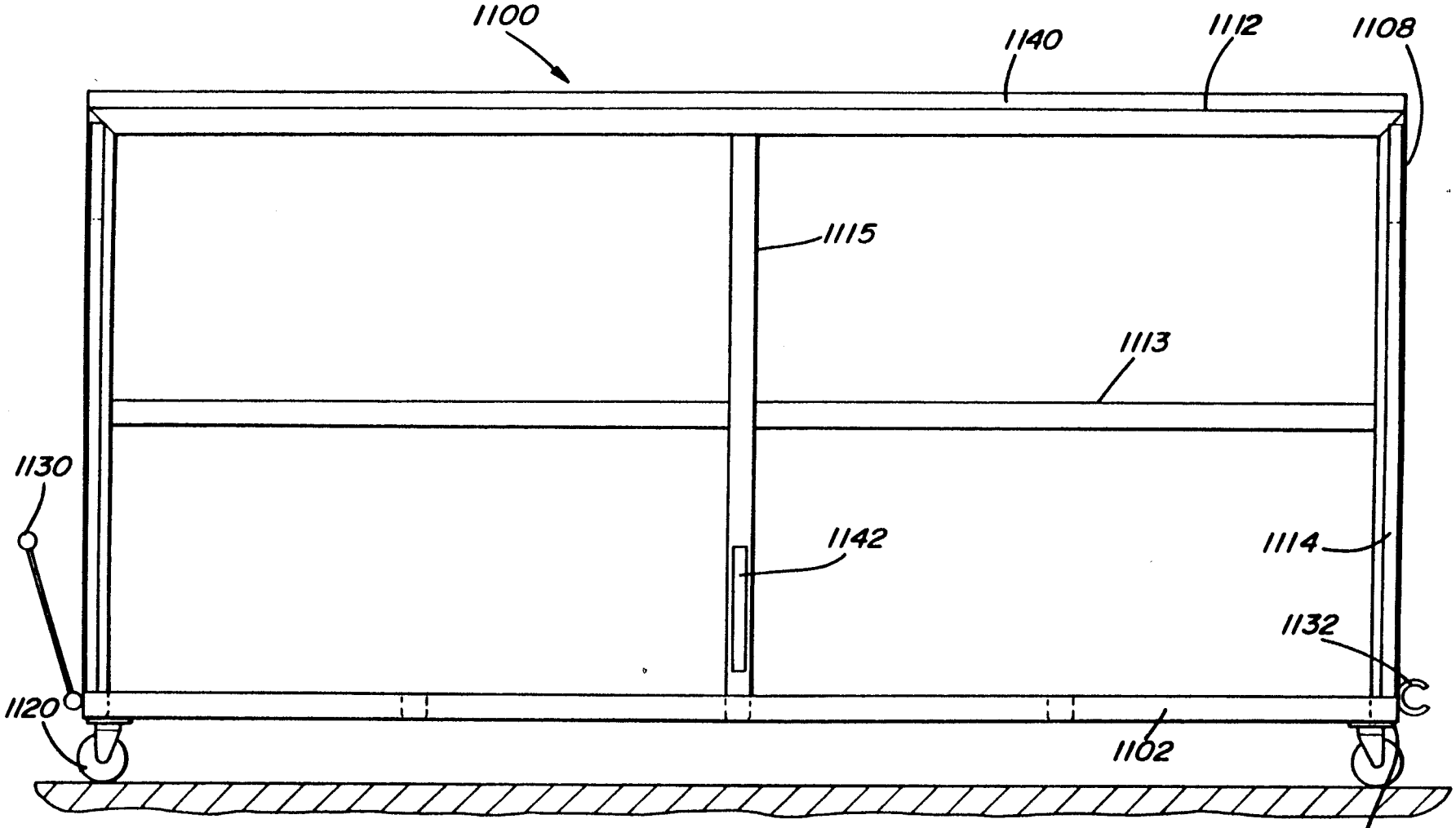

As has been mentioned earlier, an advantage of the present invention is the ability to mount and dismount the buffing fixtures 200 and metal skins 202 from one side of a trunnion table while another skin is being buffed by the robot on the other side of the table. As such, it would be advantageous to provide a rack for storing buffing fixtures while they are not currently in use. FIGS. 12A–12C illustrate a fixture dolly 1100 which serves not only to store the buffing fixtures 200 while they are not in use, but also provides a convenient way of transporting the buffing fixtures from the storage area to a loading station for mounting the buffing fixtures on the trunnion tables.

The fixture dolly 1100, when viewed in the end elevation of FIG. 12A, is wedge-shaped. The base of the fixture dolly 1100 is comprised of a rectangular base frame made up of lower longitudinal horizontal members 1102 and lower lateral horizontal members 1110. Upon the fixture dolly base is mounted a vertical frame comprised of vertical members 1108 and an upper horizontal member 1112. Additionally, the vertical frame is further stiffened by a middle horizontal member 1113 and a middle verticle member 1115. There are diagonal members 1114 extend from the outer longitudinal edges of the base up towards the upper horizontal member. In this embodiment, all support members are made of steel and are fastened together using welds.

The fixture dolly 1110 is capable of being pulled, or rolled, along the floor by way of casters 1120 bolted to the lower frame of the fixture dolly at caster mounting pads 1122. For strength considerations, swivel lock brake casters, with a 1200 pound capacity each, are preferably employed. A hitch tongue 1130 and receptacle 1132 are provided at either ends of the fixture dolly 1100 so that the multiple dollies can be linked together, similar to railroad cars, and can be guided by a vehicle such as a forklift.

A pair of rails 1140 1141 is disposed along the upper horizontal surface of the upper horizontal member 1112 to provide a wall over which the pins 254 of a buffing fixture 200 may be hooked in order to hang the buffing fixture on the dolly. The provision of the rail 1140 also facilitates the the ability of the fixture dolly 1100 to accept buffing fixtures 200 of varying sizes.

Also, to ease the loading and unloading of fixture frames as well as to minimize scraping, the center vertical support member 1115 has a plastic glide skid 1142 affixed to the outer edge of the member. The glide skid 1142 is preferably composed of ultra high molecular weight low-friction material (UHMW) which provide both a strong and resilient surface upon which to glide the fixture frames as they are being mounted on the dolly.

While it will be apparent that the preferred embodiments of the invention disclosed are well calculated to fulfill the objects stated above, it will be appreciated that the invention is susceptible to modification, variation and change without departing from the proper scope or fair meaning of the invention.

What is claimed is:

1. A structure for supporting a plurality of large and thin metal skins to permit said metal skins to be subjected to a finishing operation, comprising:

a plurality of individual fixtures, each of said fixtures having form means for removably supporting substantially an entire side of at least one of said metal skins;

at least one trunnion table mounted for rotation along a horizontally disposed axis, said trunnion table having positioning means for removably securing at least one of said fixtures; and motive power means for rotating said trunnion table.

2. The structure of claim 1 wherein each of said form means has a three-dimensional contoured surface corresponding to a unique predetermined contour of one of said metal skins for removably supporting one entire side of said metal skin.

3. The structure of claim 1 further including at least two said trunnion tables mounted for rotation along a common axis.

4. The structure of claim 3 wherein said motive power means further includes separate motor assemblies for each of said trunnion tables and means for controlling the rotation of said trunnion tables, said control means providing:

an independent mode wherein said trunnion tables are rotated independent of each other; and a tandem mode wherein said trunnion tables are rotated simultaneously and in synchronization with each other to enable a single fixture to be supported across both of said trunnion tables.

5. The structure of claim 3, wherein each of said trunnion tables includes fluid power actuated means for individually locking each of said trunnion tables into at least one predetermined rotational position.

6. The structure of claim 3, wherein each of said fixtures has projection means for enabling said fixtures to be hung on said trunnion table in a substantially vertical orientation, and said positioning means of said trunnion table includes complementary receptacle means for cooperating with said projection means of said fixtures.

7. The structure of claim 6, wherein said positioning means of said trunnion table further includes a series of two-dimensionally spaced mounting pads for enabling at least one of said fixtures to be removably secured to said trunnion table for rotation, after said fixture has been hung on said trunnion table.

8. The structure of claim 3, wherein each of said trunnion tables includes panel means for enabling the combination of both of said trunnion tables to provide one wall of an enclosure within which said metal skins are subjected to said finishing operation.

9. The structure of claim 1 wherein said positioning means cooperates with said metal skins and said form means to secure said metal skins to said form means while said metal skins are subjected to said finishing operation.

10. The structure of claim 9 wherein said structure has a working side where said finish operation occurs and a loading side, and wherein said trunnion table rotates to selectively expose said fixtures to said working side and said loading side.

11. The structure of claim 9 wherein said positioning means includes:

a plurality of index holes on said contoured surface of said form means;

at least one fixed location on said metal skin; and means for registering said at least one fixed location to at least one of said plurality of index holes, said registration means securing said metal skin on said form means in a predetermined position.

12. The structure of claim 11 wherein said registration means includes a buckle having a first tab cooperable with said fixed location and a second tab cooperable with said index holes.

13. The structure of claim 12 wherein said registration means includes a means for fixing said buckle with respect to said fixed location and said index holes.

* * * * *